US005496209A

United States Patent [19]

Gaebe

[11] Patent Number: 5,496,209

[45] Date of Patent: Mar. 5, 1996

[54] BLADE GRINDING WHEEL

[76] Inventor: Jonathan P. Gaebe, 438 Woodlawn, St. Louis, Mo. 63119

[21] Appl. No.: 174,511

[22] Filed: Dec. 28, 1993

[51] Int. Cl.[6] ..... B24B 9/00; B24D 7/14

[52] U.S. Cl. ..... 451/548

[58] Field of Search ..... 451/541, 548, 451/549, 550, 551

[56] References Cited

U.S. PATENT DOCUMENTS

| | | | |
|---|---|---|---|
| 494,471 | 3/1893 | Gardner | 451/548 |
| 2,078,120 | 4/1937 | Beth | 451/548 |
| 2,309,016 | 1/1943 | Ryan | 451/548 |
| 3,482,791 | 12/1969 | Alliegro | 451/548 |
| 4,338,748 | 7/1982 | Elbel | 451/541 |

FOREIGN PATENT DOCUMENTS

| | | | |
|---|---|---|---|
| 555767 | 4/1958 | Canada | 451/548 |
| 2332165 | 6/1977 | France | 451/548 |

*Primary Examiner*—Jack W. Lavinder
*Attorney, Agent, or Firm*—Polster, Lieder, Woodruff & Lucchesi

[57] ABSTRACT

A grinding wheel for sharpening elongated blades, such as those used for automatic fabric cutting machines, has a planar reference surface or face, and at least one surface depressed from the reference surface, all of the surfaces being coated with abrasive. In one embodiment, the grinding wheel has a radially extending cutting face, circular in elevation, with an outermost, annular, radially planar reference surface along and extending radially inboard from a radially outer edge of the face, and a second annular surface contiguous and concentric with said first surface, the second surface being radially planar and inboard radially of the outermost annular surface and axially recessed with respect to the outermost annular surface. The annular surfaces are coated with abrasive grains either of the same size or of different sizes, in the latter case, with the grain size of the abrasive grains in the inner of the surfaces being larger than the grain size on the outer surface by an amount approximately the depth of the step between the first and second annular faces. In another embodiment, a multiplicity of surfaces is provided, successively axially inwardly stepped from the radially outer surface to the radially innermost surface. In still another embodiment, the reference surface extends across the full width of the cutting annulus of the wheel, and is provided with grooves.

4 Claims, 1 Drawing Sheet

BLADE GRINDING WHEEL

BACKGROUND OF THE INVENTION

This invention is described as directed to an improved sharpening stone or grinding wheel for automated fabric cutting machines, the blades of which must be kept extremely sharp. Conventionally, the sharpening has been accomplished with grinding wheels of relatively small diameter (less than 1½ inches, typically) with a hub and a rim projecting from one edge of the hub. The rim is circular in elevation, concentric with the hub, and has a radially planar cutting face. The cutting face has bonded to it an abrasive such, for example as borozan or natural or synthetic diamond. One of the problems in the use of the present grinding wheels is that the wheel takes off more metal from the blade than is necessary to achieve the desired edge. This not only decreases blade life but wheel life as well. In the present form of the wheel, much of the abrasive is in contact with the blade which is undesirable in that only a small amount of the abrasive is needed to sharpen the saw. The abrasive also either becomes worn or otherwise loses its cutting ability. In the wheels presently used, the coarseness of the wheel has been determined by grit size alone, so that if a different coarseness has been required, a different sized has to be employed.

One of the objects of this invention is to provide a grinding wheel that can be used more efficiently and which provides a longer useful life for both wheel and blade.

Another object is to provide such a grinding wheel that is economical to manufacture.

Other objects will become apparent to those skilled in the art in the light of the following description and accompanying drawing.

SUMMARY OF THE INVENTION

In accordance with this invention, generally stated, a grinding wheel is provided for sharpening the blades of automatic cutting machines, in which a planar reference surface is interrupted. In one embodiment, a radial cutting face of the grinding wheel is stepped to provide successive annular surfaces, stepped axially inwardly successively from the radially outermost surface to the radially innermost surface. The surfaces carry abrasive grains that can be of the same size or of successively larger sizes from the smallest on the radially outermost surface to the radially innermost surface.

The advantages of such an arrangement are several. As the abrasive on the outermost surface wears or dulls, or the blade is ground back with repeated sharpening, the wheel can be moved toward the blade to bring the blade into contact with fresh abrasive without wearing down the blade or wheel excessively, because the abrasive on the outermost surface is, by definition, worn or dulled.

In another embodiment, the reference surface is interrupted by grooves, both the surface and the grooves being coated with abrasive. This embodiment has several advantages, including the use of a single grit size to accomplish various degrees of coarseness, and the reduction in "stepping" of the blade.

DRAWINGS

DESCRIPTION OF THE PREFERRED EMBODIMENT

Figure 1:
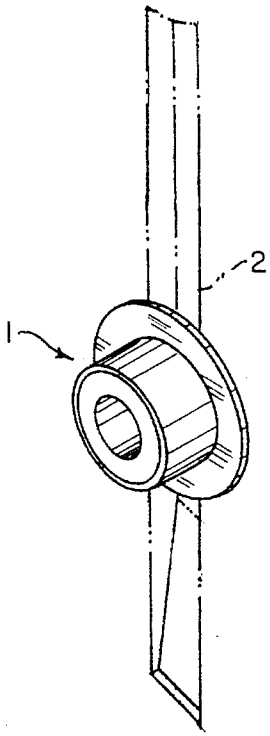
FIG. 1 is a view in prospective of a grinding wheel in the process of grinding a blade.
Figure 2:
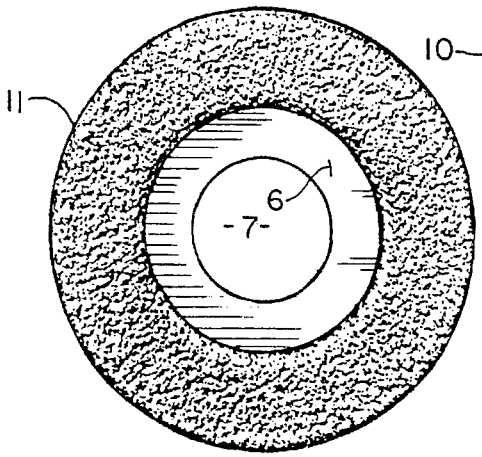
FIG. 2 is a view in front elevation of a conventional grinding wheel.
Figure 3:
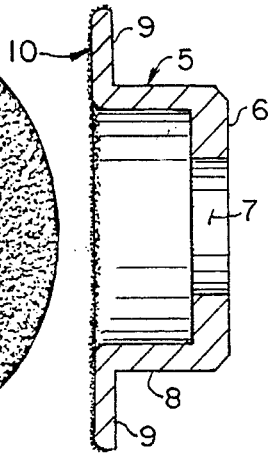
FIG. 3 is a diametric sectional view of the wheel shown in FIG. 2.

Referring to FIGS. 1 through 3 of the drawing for conventional grinding wheels of the sort to which this invention has application, reference numeral 1 indicates a grinding wheel, mounted on a shaft, not here shown, for rapid rotation. In FIG. 1, the wheel 1 is shown as grinding an edge on a blade 2 of the type commonly used in automatic fabric cutting machines. The wheel 1 has a cup-shaped hub 5, with a bottom wall 6 through which a shaft passage 7 extends, a cylindrical side wall 8, co-axial with the passage 7, and rim 9 projecting radially outwardly from an axially outer edge of the cylindrical side wall 8.

All of these elements are conventional, and are common to the preferred embodiments of the present invention.

In the conventional grinding wheel, the rim 9 has a radially planar axially outer cutting face 10, to which abrasive grains, such as borozan or natural or synthetic: diamond, are bonded. As indicated particularly in FIG. 3, the face 10 is uniformly planar.

Figure 4:
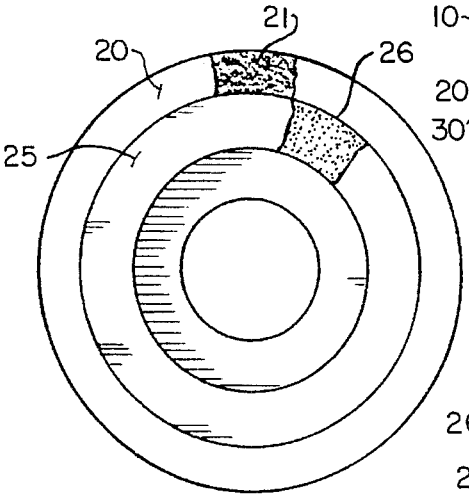
FIG. 4 is a view in front elevation of one embodiment of the grinding wheel of this invention with abrasive shown fragmentarily for clarity.
Figure 5:
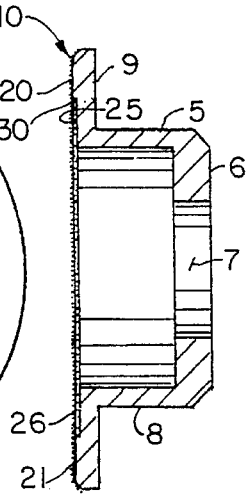
FIG. 5 is a diametric sectional view of the wheel shown in FIG. 4.
Figure 8:
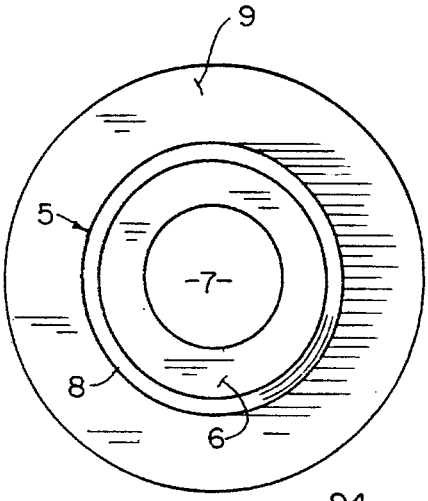
FIG. 8 is a view in rear elevation of the wheel shown in FIGS. 1 through 7.

Referring now to FIGS. 4 and 5 for one embodiment of the grinding wheel of this invention, the cutting face 10 is stepped to provide a first, radially outermost annular face 20, and a second, radially inner, radially planar face 25, positioned axially inboard of the face 20. The two faces 20 and 25 are separated by a step 30. The face 20 is coated with an abrasive 21. The face 25 is coated with an abrasive 26. In the embodiment shown, the abrasives 21 and 26 have the same grain size, and are of the same composition. However, as has been indicated, the grain size of the abrasive 21 can be smaller than that of the grains 26, and the abrasives themselves can be different as for example one of borozan and another of diamond. The height of the step 30 is determined by the amount of expected wear on that step. If the maximum amount of wear wanted is 0.005 inch, and that allows for maximum use of the abrasive, the height of the step will be 0.005 inches, particularly if the grain size of the two abrasive surfaces is the same. Merely as examples, but not by way of limitation, if the diameter of the rim 9 is one and three eighths (1⅜) inches, the radial width of the face 20 can be one eighth (⅛) inch, and of the face 25, three sixteenths (3/16), for a total of five sixteenths (5/16). The height of the step 30 can be as indicated 0.005 inches, although, as has been indicated, that can very vary depending upon the wear characteristics and the amount of exposed surface of the abrasive.

Figure 6:
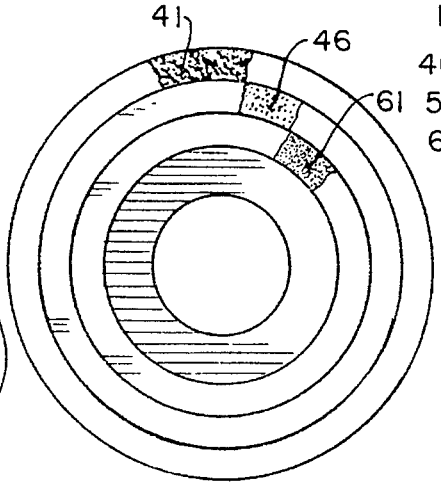
FIG. 6 is a view in front elevation of another embodiment of the grinding wheel of this invention with abrasive shown fragmentarily for clarity.
Figure 7:
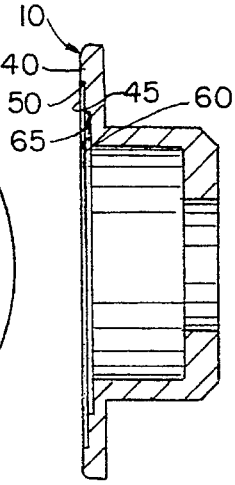
FIG. 7 is a diametric sectional view of the wheel shown in FIG. 6.

Referring now to FIGS. 6 and 7 for a second embodiment, three radial planar surfaces 40, 45, and 60 are formed in the face 10, with steps 50 and 65 between them. The second surface 45 is concentric with and contiguous the first or outermost face 40; the face 60 is concentric with and contiguous the face 45 and radially inward of it.

In the three-face embodiment, the steps are preferably shallower than in the two face embodiment shown in FIGS. 4 and 5. For example, the steps 50 and 65 can each be 0.003 inches. Each of the faces 40, 45, and 60 must necessarily be of less radial width than those of the embodiment shown in FIG. 5. Merely by way of example, if the total effective width of the face 10 is nine thirty seconds (9/32) inches, the radial widths of the faces 40, 45, and 60 can be three thirty-seconds (3/32), seven sixty-fourths (7/64), and seven sixty-fourths (7/64) inches, respectively. These are merely illustrative, because, as can easily be seen, these dimensions can vary to suit the requirements of any particular application.

The faces 40, 45, and 60, are covered with abrasive 41, 46, and 61, respectively.

It can been seen that as the grinding wheel is used as shown in FIG. 1, only the abrasive 21 or 41 will bear initially upon the blade 2 until the abrasive has worn down to the point at which the next ring of abrasive 26 or 46 begins to cut the metal. In the case of the embodiment shown in FIG. 6, the process is repeated with the abrasive 46 until the abrasive 61 has begun to work.

As has been indicated, the grain size of the abrasives 21 and 26 or 41, 46, and 61, can be varied. The advantage of such an arrangement over the conventional wheel is that the wear rate or dulling rate of the smaller abrasive particles, at the outer surfaces of the wheel is likely to be greater than that of the larger grains, and because the effective speed of the .inner rings is less than that of the outer, the cutting is more uniform across the face of the wheel.

Figure 9:
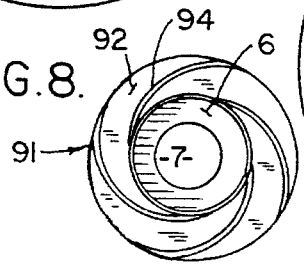
FIG. 9 is a view in front elevation, on a reduced scale of yet another embodiment of grinding wheel of this invention.

Referring now to FIG. 9 for yet another embodiment of grinding wheel of this invention, reference numeral 91 indicates a grinding wheel with an annular planar reference face 92, in which spiral grooves 94 are cut, extending from a radially inner edge of the face 92 to the radially outer edge of the face 92. The grooves 94 are of sufficient depth and width, for example, 1/32 inch deep and 0.050 inch wide, so that when the face 92 and grooves 94 are coated with borozan, as by brazing, the grooves are still visible. It has been found that when the borozan is applied concentratedly, its effect is to produce a finer cut than when the particles are spread more thinly, e.g., the concentrated or crowded borozan acts as if the grit size were smaller. If the borozan in the grooves is then cut down, to provide a deeper channel than when the borozan is first applied, the effect is to increase the coarseness of the wheel. Thus, by varying the width and depth of the channel or groove, various degrees of coarseness can be obtained with one grit size.

Numerous variations in the construction of the wheel of this invention, within the scope of the appended claims, will occur to those skilled in the art in the light of the foregoing disclosure. Merely by way of illustration, the height of the steps can be varied, the number of stepped faces can be increased, the design of the wheel hub can be varied, because it has nothing to do with the essence of the invention, and the wheel itself can be made of different materials and even of abrasive itself. The grooves of the last embodiment can be varied in configuration as well as depth and width. These are merely illustrative.

Having thus described the invention, what is claimed and desired to be secured by Letters Patent is:

1. In a grinding wheel for sharpening the blades of automatic fabric cutting machines, said wheel having a metal hub and a rim integral with said hub and projecting radially from an edge of said hub, said rim having a radially extending outer face and abrasive grains bonded to said face, the improvement comprising a first outermost annular, radially planar surface along and extending radially inboard from a radially outer edge of said face, and, radially inwardly from said first outermost annular surface, a plurality of concentric annular radially planar surfaces, stepped axially inwardly successively from the radially outermost to the radially innermost.

2. The improvement of claim 1 wherein each of said annular surfaces carries abrasive grains of the same size.

3. The improvement of claim 1 wherein successive radially inward annular surface carry successively larger grains.

4. The grinding wheel of claim 1 wherein the height of the step between successive surface is on the order of 0.002 to 0.007 inches.

* * * * *